United States Patent [19]

Elliott

[11] Patent Number: 4,600,379

[45] Date of Patent: Jul. 15, 1986

[54] DRUM HEATING AND MIXING APPARATUS AND METHOD

[76] Inventor: E. J. Elliott, 143 Variety Tree Cir., Altamonte Springs, Fla. 32714

[21] Appl. No.: 773,950

[22] Filed: Sep. 9, 1985

[51] Int. Cl.[4] ..... F27B 14/00; F27B 7/02; E01C 19/45; B28C 5/46

[52] U.S. Cl. ..... 432/13; 126/343.5 A; 366/2; 366/25; 432/106

[58] Field of Search ..... 432/13, 106; 126/343.5 A; 366/2, 25

[56] References Cited

U.S. PATENT DOCUMENTS

| | | | |
|---|---|---|---|
| 2,411,751 | 11/1946 | Overman | 432/106 |
| 4,189,300 | 2/1980 | Butler | 432/118 |
| 4,262,429 | 4/1981 | Avril | 34/33 |

*Primary Examiner*—John J. Camby
*Attorney, Agent, or Firm*—William M. Hobby, III

[57] ABSTRACT

A combination direct/indirect fire drum heating and mixing apparatus includes a frame having an inner cylindrical drum rotatably supported thereto and having an aggregate input in one end thereof and an aggregate output at the other end thereof. A concentric outer drum is mounted around the inner drum and has an aggregate input from the material output of the inner drum and an aggregate output therefrom at the other end thereof, so that aggregate materials can pass through the inner drum and then pass between the inner and outer drums. A burner is mounted to one end of the inner cylindrical drum for directing a flame thereinto and includes a burner blower for blowing atmospheric air under pressure into the burner. An exhaust gas outlet duct operatively connects the exhaust gas from the inner cylindrical drum to the atmosphere or particulate-removing apparatus, while an exhaust gas feedback siphons vapors and gases emitted in the space between the two drums for incineration through the system burner. An asphalt cement injection nozzle injects asphalt cement into the aggregates passing through the concentric outer drum. A second aggregate feed can direct recycled asphalt pavement materials into the concentric outer drum and a dust recovery zone may be provided along with rotating screws for moving the final product discharge or the collected dust.

16 Claims, 2 Drawing Figures

DRUM HEATING AND MIXING APPARATUS AND METHOD

BACKGROUND OF THE INVENTION

The present invention relates to a continuous drum dryer mixer system, and especially to a system for heating and drying virgin aggregates, as well as recycled asphaltic pavement materials and mixing such with liquid asphalt cement in the preparation of asphalt paving materials.

In the past, asphalt plants have generally been of two types, the Batch type, and more recently the Drum Mix type. Batch type plants typically have hopper feeds for feeding different sizes of unweighed cold aggregate materials by means of a cold feed conveyor into the dryer. The dryer typically involves a large elongated drum having a burner directed into one end, with the aggregate being fed therethrough from the other end, and providing rotation of the drum with flights for lifting the aggregate material and dropping it through the hot gases and causing it to be dried. As the material passes through the drum, the hot air and gases pass out of the other end of the dryer into a ducting system which is directed towards a wet wash, mechanical collector, or fabric filter dust collector for cleaning the air and gases prior to their discharge from a stack. Meanwhile, the dried aggregate materials are fed up a bucket type hot elevator to a batching tower, where the material is passed through screens for separating it into sizes and storing it into separate compartments whence it is withdrawn pursuant to various formulas into the weigh box. After weighing, the aggregates are dropped into a mixer at the bottom of the tower where the exact amount of hot liquid asphalt is added, along with mineral fillers, and mixed to specified time durations, prior to loading into a truck. This type of plant has been the most commonly used around the world, but has the disadvantages of not being able to process recycled asphaltic pavement materials.

The drum mix plant has a feed system which preproportions the ratios of the various aggregates on to the cold feed conveyors, feeds it into a rotating elongated drum dryer where a burner is directed into the same end as the cold aggregates. As the aggregates tumble and progress through the rotating drum dryer they absorb heat and shed moisture. Half-way into the drum liquid asphalt is injected which mixes with the aggregates through the tumbling action and exit the dryer discharge as a finished mixture ready to be loaded into trucks from hauling to the paving site. This type of drum mix plant is most commonly used to process some ratio of recycled asphaltic pavement (RAP) which is introduced into the elongated drum dryer at about midpoint. The disadvantage of this drum mix plant is that since both the liquid asphalt, as well as the recycled asphaltic pavement are introduced into the same single elongated drum dryer into which the intense fire is released from the burner, and subjected to the high velocity of the plant exhaust system. The high temperature from the flame and combustion gases cause burning of the liquid asphalt, degradation of quality of the finished product, release of volatiles from the liquid asphalt, as well as the asphaltic pavement materials, generation of blue smoke and other severe pollutants, release of odors, and also can cause fires and explosions from the gasified volatiles which tend to recondense into liquid from in the plastic filters of the exhaust system.

Prior U.S. Pat. No. 4,262,429 deals with a method of and apparatus for drying materials which uses coaxial cylinders with one being fed moist fine aggregates and the other being fed moist course aggregates for mixing and drying the aggregates. It does not deal with the manufacture of paving asphalt nor the use of recycled asphalt and does not provide the pollution reduction (for asphalt plants) accomplished with an exhaust feedback loop and dust collection chamber.

The present invention is directed to an asphalt plant which can process a mixture of recycled asphalt and virgin materials or can process only virgin materials, without oxidizing, distilling or burning the liquid asphalt, or that of the recycled asphaltic paving material; and without releasing volatile matter, particulate pollutants, or odors. The plant utilizes the waste heat in the system for controlling the temperature of the product, and contains and incinerates any vapors which may be released by the finished product.

It is accordingly, an aim of the present invention to provide an aggregate and virgin asphalt plant which can utilize recycled asphalt materials and produce a superior product utilizing substantial amounts of normally wasted energy, and dramatically reduce release of environmental pollutants, as well as reduce fire and explosion hazards.

SUMMARY OF THE INVENTION

A drum heating and mixing apparatus includes a housing or frame having an inner cylindrical drum rotably supported thereon and having a first material input in one end portion thereof and a material output at the other end thereof. A concentric outer drum is mounted around the inner drum and has a material input from the material output of the inner drum and the material output therefrom at the other end thereof, so that materials passing through the inner drum will pass between the inner and outer drums. A burner is mounted to one end of the inner cylindrical drum for directing a flame thereinto and includes a burner blower for blowing atmospheric air into the burner. An exhaust gas outlet duct is operatively connected to an exhaust gas opening in the other end of the inner drum from the burner opening and connects the drum to an exhaust system with various dust filtering devices and thence to the atmosphere. An optional feature may draw vapors from the chamber between the two drums and feed these to the burner where they will be incinerated, thus eliminating pollution while utilizing the energy from the volatile matter of the vapors. An asphalt cement injection nozzle is connected to the frame and protrudes into the path of the moving materials for spraying the materials.

A second material input can be positioned to direct recycled asphalt materials into the concentric outer drum for mixing the heated aggregates and the asphalt cement injected into the mixture.

A dust recovery zone may be provided in the form of a cylinder, or a housing surrounding the outer concentric cylinder, where the primary exhaust exiting the inner cylinder will expand and slow down, thus shedding most of the heavier dust which can be airborne through the inner cylinder. At the same time, these exhaust gases are caused to spiral about the periphery of the outer cylinder further transferring onto it heat before exiting from the outlet at the opposite end, further conserving energy. The dust collected in this chamber can be removed through mechanical conveyors, or pneumatically, and be stored or injected into the outer cylinder for mixing with the liquid asphalt and aggregates, as a necessary component of the mixture specifications.

BRIEF DESCRIPTION OF THE DRAWINGS

Other objects, features and advantages of the present invention will be apparent from the written description and the drawings in which.

DESCRIPTION OF THE PREFERRED EMBODIMENTS

Figure 1:
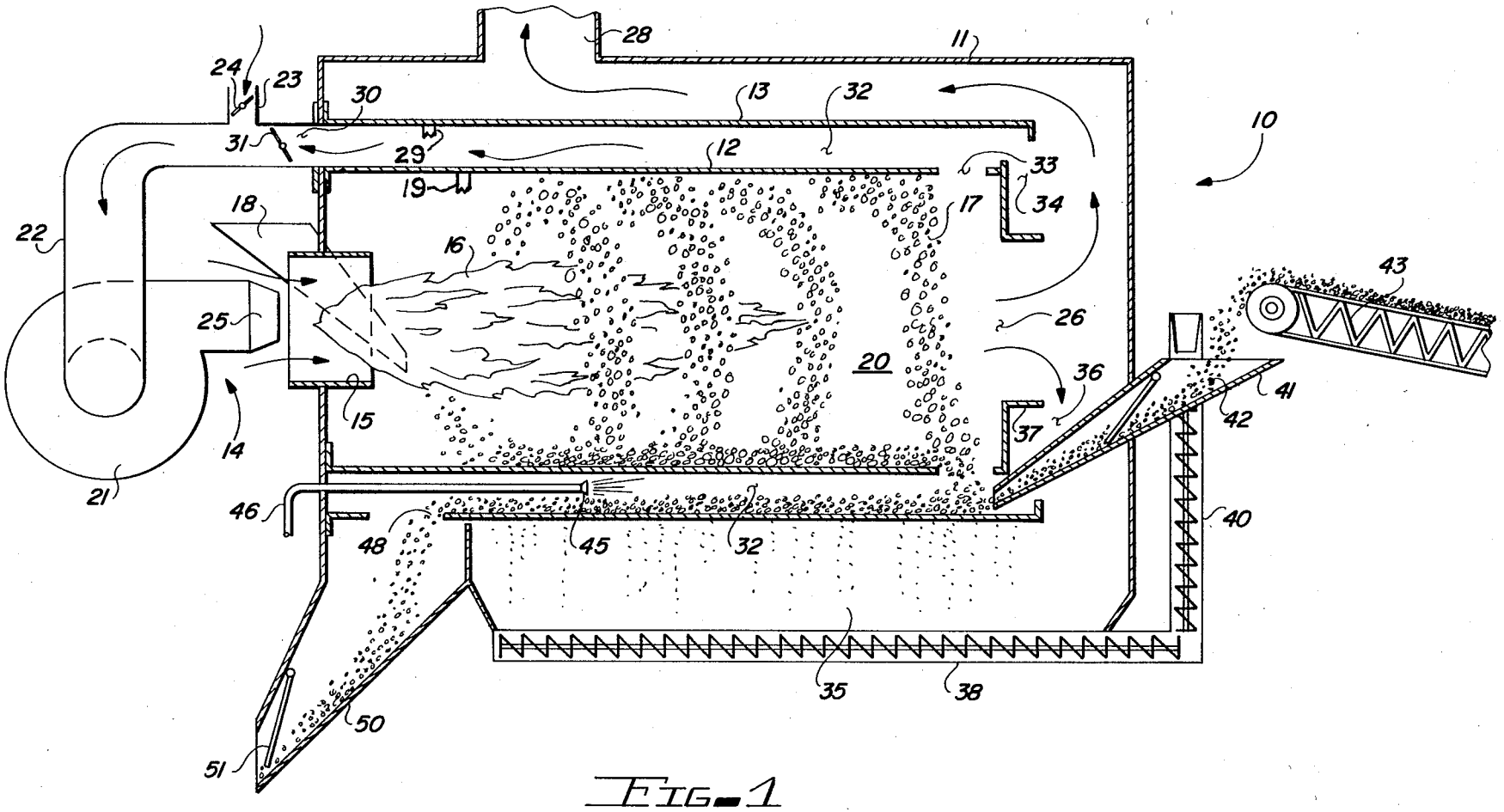
FIG. 1 is a sectional view of drum heating and mixing apparatus in accordance with the present invention.
Figure 2:
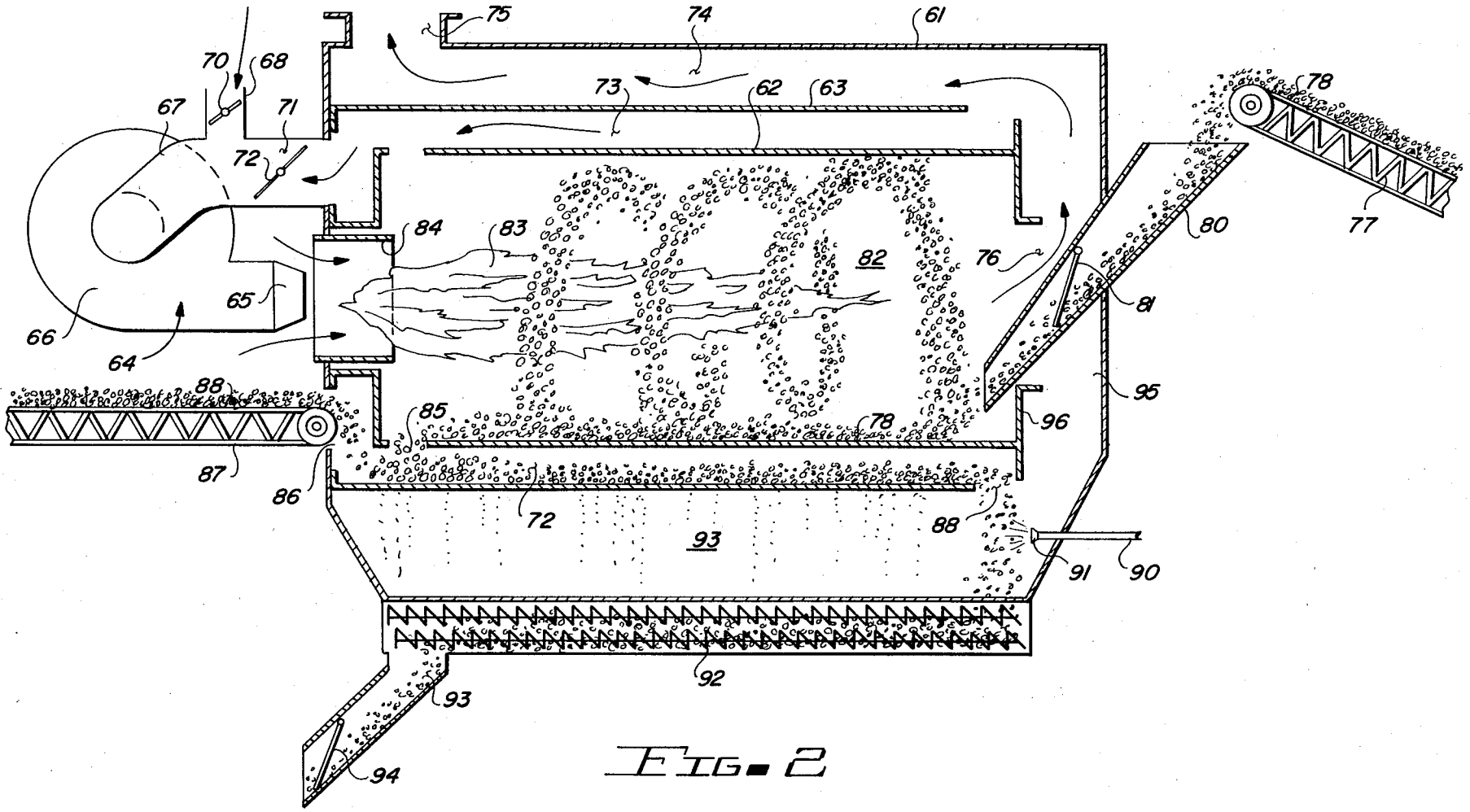
FIG. 2 is a sectional view of a second embodiment of a drum mixing and heating apparatus in accordance with the present invention.

Referring to FIG. 1 of the drawings a drum mixing and heating apparatus 10 is especially suited for heating aggregates for mixing with asphalt cement in combination with recycled asphaltic materials. The apparatus 10 is supported in a housing 11 and has an inner rotating drum 12 and an outer concentric rotating drum 13, which is attached to an rotates with the inner drum 12, thereby forming an annular cylindrical passageway between the inner and outer drums 12 and 13. A burner 14 is placed in a burner opening 15 for directing a flame 16 into the inner drum 12 for heating and drying aggregate 17 therein. The aggregate is fed through the virgin aggregate feed 18 into the chamber 20 of the inner drum 12, and during rotation of the drum 12 the aggregates 17 are rotated in a spiralling direction around the flame 16. This can be accomplished with flights 19 partially shown in the center drum 12, and flights 29 partially shown in concentric drum 13 but as shown in prior U.S. Pat. Nos. 4,189,300 and 4,262,429. The burner 14 has a burner blower 21 for directing the atmospheric air under a positive pressure through the burner. The air is drawn through an air passageway or duct 22 and through an air inlet 23 connected to atmospheric air through a damper 24. Fresh air is also fed into the chamber 20 through the opening 15 as shown by the arrows passing around the burner nozzle 25. The exhaust air and gases are fed from the cylindrical drum 12, chamber 20 through an exhaust opening 26 through an exhaust duct 27 formed by a portion of the housing 11 in the outside of the outer concentric drum 13. The exhaust gases are fed out an exhaust outlet 28 into particulate filters and thence through a stack into the atmosphere. The burner blower air duct 22 which is under a negative pressure from the blower 21 has an auxiliary inlet 30 through a damper 31 which connects the top portion of the apparatus 10 with the annular passageway 32 formed between the inner drum 12 and the outer drum 13. This is connected by virtue of the opening formed by the annular opening 33 formed at the end of the drum 12, allowing material to move from drum 12 to drum 13, and also by a second annular opening 34. This allows the blue smoke from the asphalt impinging on the hot materials and which is heavier than the remaining exhaust to be captured by the negative pressure from the suction on inlet 30 through the top of the annular opening 32. A very low capacity fan or blower 21 can be used to draw off the blue smoke which is oxygen rich enough to allow it to be introduced with the primary air of the burner blower into the burner and thereby consumed as fuel while avoiding the blue smoke pollution and smell. Heavier particles of dust, however, are directed by virtue of their weight downward into a dust recovery zone or chamber 35 passing through the opening 26 and around the end of passageway 36 between the housing 11 and the drum portion 37. The recovered dust is then collected by a dust screw conveyor 38 and fed up a vertical feed conveyor 40 and dumped into a recycled asphalt feed chute 41 along with recycled asphalt 42. The recycled asphalt can be broken up and may be crushed paving material, or the like. The recycled asphalt materials 42 are fed from a conventional conveyor 43 onto the chute 41 and pass through an opening 44 between the drum portion 37 and the outer drum 13 where it is mixed with the heated and dried aggregates being fed through the opening 33 from the first drum 12 to the second drum 13. The virgin aggregates and the recycled materials are mixed in the space 32 between the drums 12 and 13. As the mixture of materials move along the space 32, they encounter the nozzle 45 for the asphalt cement injection fed through the cement injection pipe 46. The materials 47 being fed through the annular opening 48 in the outer drum 13 are a mixture of virgin aggregate materials which have been heated and dried along with recycled asphaltic materials and the asphalt cement mixed therewith. This mixture 47 is dropped onto an exit chute 50 which goes through an exit chute door 51 and is discharged from the apparatus 10.

The advantage of the drum mixer, drier and heater 10 is that the flame can be applied directly to the inner drum 12 for heating the virgin aggregates but avoids applying the direct flame to the recycled materials or asphalt cement injected into the mixture. This mixture is mixed in the outer concentric drum and is heated by virtue of the heat from the walls of the inner drum 12 the walls of the outer wall 13, as well as the heated aggregates 17 being fed directly thereinto. The system, advantageously, provides for a dust recovery and recycling zone as well as a blue smoke feedback loop which reduces pollution and increases the energy efficiency of the system. The mixing is done in a static environment with no gas movement, so that it will not affect the exhaust and there is no asphalt content or hydrocarbon emitted from the liquid asphalt nor the recycled asphaltic materials into the exhaust system as they are injected into the drum mixer. The aggregates reach the end of the internal cylinder 12 heated to slightly above the specified final products temperature. This heat is then transferred into the mixture of recycled materials and heated asphalt cement, so as to blend down to the exact temperature specified for the final product.

A second embodiment is illustrated having an asphalt drum mixer 60 having a housing 61 with an internal drum 62 and a concentric outer drum 63. A burner 64 with a burner nozzle 65 has a blower 66 connected to a blower duct 67 and to an outlet 68 having a damper 70. An auxiliary outlet 71 through a damper 72 connects to blower intake duct 67 to the annular passageway 73 between the drum 62 and 63. An exhaust duct or passageway 74 feeds out an exhaust outlet 75 and collects the exhaust gases through an end opening 76 from the inner drum 62 similar to the embodiment illustrated in FIG. 1. In this embodiment a virgin aggregates 78 gets fed on a conveyor 77 onto a chute feed 80, through a chute door 81 and through the opening 76 into the inner chamber 82 of the inner drum 62. The rotation of the connected drums 62 and 63 rotates the aggregates 78 in a spiraling fashion as shown in the drawing, but in an opposite direction from the burner of FIG. 1, but moving the aggregates around the flame 83 from the burner 84. The direction of rotation of the aggregates is controlled by the flights. The flame 83 passes through the opening 84 along with fresh air to create both the flame and heated air for heating the aggregate 78. The aggregates are fed from the inner drum 62 through an annular opening 85 at the opposite end of the opening 76 into the annular passageway 73 between the drums 62 and 63. Adjacent the opening 85 is an opening 86 through the housing 61 where a recycled asphalt material conveyor 87 feeds the recycled asphaltic materials 88 thereinto and into the passageway 73 where the materials are mixed as they pass along the annular space between the drums 62 and 63 until they are fed out of an annular opening 88. As they are fed out of the opening 88, an asphalt cement feed pipe 90 feeds an asphalt cement injection nozzle 91 to spray the asphalt cement directly onto the mixed virgin aggregates and recycled materials. This mixture is then fed into a twin counter-rotating screw feed 92 which further mixes the materials as they pass from one end to the other of the screw 92 and into the discharge chute 93 which has a discharge door 94 for discharging the materials from the apparatus.

In this embodiment lime, solids and dust pass through the opening 76, through a passageway 95 between the drum portion 96 and the outer housing 61 into a dust recovery zone 97 directly above the twin counter-rotating screws 92, so that the dust is accumulated into the rotating screws and discharged with the asphaltic materials and aggregate mix. Thus, the counter-rotating screws 92 both move the mixed aggregates and asphaltic materials, which further mixing them, as well as capturing the dust at the same time for mixing therewith, and for discharge from the system. The blue smoke in this embodiment is captured through an opening 97 from the passageway 74 and into the passageway 73 for recycling back through the burner blower 66 and burner 64.

It should be clear at this time that a system has been provided for the heating and dehydrating of virgin aggregates or minerals under direct fire of a burner and then using an outer concentric cylinder for mixing these heated and dried materials with recycled materials and with the liquid asphalt injected thereinto for coating the particles, thereby capturing the heat not only from the aggregates but from the heated inner cylinder through the walls into the space between the inner and outer cylinders. The system also allows the inner chamber between the inner and outer cylinders to have recycled asphaltic pavement materials, which has been previously crushed, fed thereinto to absorb the indirect heat without being subjected to the direct flame for blending with the overheated virgin aggregates. The final product will typically be a hot asphalt paving mix.

The present invention, however, is not to be considered limited to the forms shown which are to be considered illustrative rather than restrictive.

I claim:

1. Drum heating and mixing apparatus comprising in combination:

a housing;

an inner cylindrical drum rotably supported on the housing and having a first material input in one end portion thereof and a material output at the other end thereof;

a concentric outer drum mounted around said inner drum and having a material input from the material output of the inner drum and a material output therefrom at the other end thereof, whereby materials passing through said inner drum will pass between said inner and outer drums;

a burner mounted to one end of said inner cylindrical drum for directing a flame thereinto;

exhaust gas outlet duct operatively connecting an exhaust gas opening in the other end of said inner drum from said burner to the atmosphere;

an exhaust gas and vapor feedback means for drawing off heavier gases and vapors from said exhaust gases from the static area between the inner and outer drums and feeding the drawn off gases to the burner blower with the atmospheric air;

asphalt cement injection nozzle means connected to the housing and protruding into the path of the material leaving the inner drum for spraying minerals onto said materials; and a second material input feed positioned to direct materials into said concentric outer drum, whereby asphalt paving materials can be produced using recycled asphaltic materials.

2. A drum heating and mixing apparatus in accordance with claim 1 including a dust removal chamber in said housing connected to said inner cylindrical drum for capturing dust therefrom.

3. A drum heating and mixing apparatus in accordance with claim 2 including a screw conveyor located in said dust removal chamber for capturing the dust therein, said screw conveyor being connected to direct said capture dust particles back into said outer drum.

4. A drum heating and mixing apparatus in accordance with claim 2 in which said dust removal chamber has a screw conveyor mounted therein and an opening from said concentric outer drum to said conveyor for conveying said mixture from said housing, said screw conveyor being adapted to capture dust particles in said dust removal chamber into said discharge materials.

5. A drum heating and mixing apparatus in accordance with claim 4 in which said asphalt cement injection nozzle means has a nozzle placed adjacent to the discharge of materials from said concentric outer drum for spraying said materials as they fall into said screw conveyor.

6. A drum heating and mixing apparatus in accordance with claim 5 in which said burner includes a burner blower for blowing atmosphere air into the burner and into the inner cylindrical drum.

7. A drum heating and mixing apparatus in accordance with claim 6 in which said housing includes a discharge chute for discharging said materials therefrom, said discharge chute having discharge chute door covering the discharge opening therefrom.

8. A drum heating and mixing apparatus in accordance with claim 1 in which said inner cylindrical drum material input includes an aggregate input chute in one end thereof.

9. A drum heating and mixing apparatus in accordance with claim 8 in which said second material input feed includes a conveyor for feeding recycled asphaltic pavement material connected to an input chute at one end of said concentric outer drum, said input chute having an input chute door.

10. A drum heating and mixing apparatus in accordance with claim 1 in which said exhaust gas and vapor feedback means includes a damper located in the connection between said concentric inner and outer drums and said burner air input.

11. A drum heating and mixing apparatus in accordance with claim 1 in which said burner includes an air input from atmosphere having a damper positioned therein and connected adjacent the exhaust gas and vapor feedback means input.

12. A method of producing asphaltic pavement materials comprising the steps of:

feeding aggregate materials to an inner rotating drum;

directing a burner flame into said inner drum for heating said aggregate materials fed thereinto;

directing said aggregate materials from said inner drum to an outer concentric drum attached to said inner drum for feeding between said inner and outer drums;

feeding used asphaltic materials to said outer drum for mixing with said aggregate materials being fed from said inner drum;

spraying said mixture of aggregates and used asphaltic materials with an asphalt cement;

mixing said aggregates, used asphaltic materials and asphalt cement; and discharging said mixture for use as a paving material.

13. The method in accordance with claim 12 including the step of drawing off heavier gases from the exhaust gases of the inner drum and feeding the drawn off gases to the burner flame along with atmospheric air.

14. The method in accordance with claim 13 including the step of collecting exhaust dust from said inner drum in a dust removal chamber.

15. The method in accordance with claim 12 including the step of mixing dust collected in said dust removal chamber into the mixture of aggregates and recycled asphalt materials.

16. Drum heating and mixing apparatus comprising in combination:

a housing;

an inner cylindrical drum rotably supported on the housing and having a first material input in one end portion thereof and a material output at the other end thereof;

a concentric outer drum mounted around said inner drum and having a material input from the material output of the inner drum and a material output therefrom at the other end thereof, whereby materials passing through said inner drum will pass between said inner and outer drums;

a burner mounted to one end of said inner cylindrical drum for directing a flame thereinto;

exhaust gas outlet duct operatively connecting an exhaust gas opening in the other end of said inner drum from said burner to the atmosphere;

a dust collection chamber in said housing and connected to the output of said inner cylindrical drum for collecting dust therein;

means to direct collected dust in said dust collection chamber back into the output materials;

asphalt cement injection nozzle means connected to the housing and protruding adjacent the path of the material leaving the outer drum for spraying minerals onto said materials;

a second material input feed positioned to direct materials into said concentric outer drum; and output means for discharging materials from said housing, whereby asphalt paving materials can be produced using recycled asphaltic materials.

* * * * *